US005492408A

United States Patent [19]

Alfaré

[11] Patent Number: 5,492,408

[45] Date of Patent: Feb. 20, 1996

[54] STATIC MIXING APPARATUS

[75] Inventor: Georges Alfaré, Oberengstringen, Switzerland

[73] Assignee: Sulzer Chemtech AG, Winterthur, Switzerland

[21] Appl. No.: 336,613

[22] Filed: Nov. 9, 1994

[30] Foreign Application Priority Data

Nov. 26, 1993 [EP] European Pat. Off. ..... 93810829

[51] Int. Cl.[6] ..... B01F 5/06

[52] U.S. Cl. ..... 366/337; 366/340

[58] Field of Search ..... 366/336–338, 366/340; 138/37, 38, 42; 165/109.1

[56] References Cited

U.S. PATENT DOCUMENTS

| | | | |
|---|---|---|---|
| 2,067,133 | 1/1937 | Wales | 138/38 |
| 3,235,003 | 2/1966 | Smith | 138/38 X |
| 4,019,719 | 4/1977 | Schuster et al. | 366/338 |
| 4,296,779 | 10/1981 | Smick | 366/337 X |
| 4,336,838 | 6/1982 | Ely | 165/109.1 |
| 4,497,751 | 2/1985 | Pluss | 366/337 X |
| 4,497,752 | 2/1985 | Huber | 366/337 X |
| 4,497,753 | 2/1985 | Streiff | 366/337 X |
| 4,511,258 | 4/1985 | Federighi . | |
| 4,710,326 | 12/1987 | Seah . | |
| 4,765,204 | 8/1988 | Buchholz et al. | 366/337 X |

FOREIGN PATENT DOCUMENTS

| | | | |
|---|---|---|---|
| 0070915 | 2/1983 | European Pat. Off. . | |
| 0070916 | 2/1983 | European Pat. Off. . | |
| 0072875 | 3/1983 | European Pat. Off. . | |
| 4028437 | 3/1992 | Germany | 165/109.1 |
| WO93/04771 | 3/1993 | WIPO . | |

*Primary Examiner*—Charles E. Cooley

*Attorney, Agent, or Firm*—Townsend and Townsend and Crew

[57] ABSTRACT

The static mixing apparatus for a flowing medium comprises a tubular housing (4) and at least one mixing element (3) disposed in the housing, the structural elements of which are essentially bars (11, 12, 21, 22). The housing defines a main direction of flow (5) of the medium and the bars (12, 22) exerting the mixing action enclose an angle with the main direction of flow. The mixing element is formed from at least two strip-like, substantially zig-zag or wavy sections (1, 2). The mixing element is preferably designed essentially rotational symmetrical in relation to a 180° rotation around the main direction of flow.

5 Claims, 4 Drawing Sheets

STATIC MIXING APPARATUS

BACKGROUND OF THE INVENTION

The invention relates to a static mixer or mixing apparatus for a flowing medium, the mixer having a tubular housing which defines a main direction of flow for the medium. At least one mixing element disposed in the housing has structural elements, essentially in the for of bars, which exert the mixing action and enclose an angle relative to the main direction of flow.

Such an apparatus is known from Swiss Patent Specification 642 564 or German Patent Specification 28 08 854. The mixing element utilized by such apparatus comprises a structure which is constructed of interengaging, intersecting bars. The bars form two groups of structural elements which are in mutually parallel alignment.

SUMMARY OF THE INVENTION

The manufacture of the known mixing elements is relatively expensive because they are assembled by, for example, welding individual bars together.

It is therefore an object of the invention to create a mixing apparatus for which a more cost-favorable manufacturing method is available. This object is achieved with an apparatus having a mixing element which is formed of at least two strip-like, substantially zig-zag or wavy sections.

The mixing element is further preferably substantially rotationally symmetrical in relation to a 180° C. rotation about the main direction of flow. In the present description only embodiments which display this rotational symmetry are shown. However it is, for example, possible that the two strip-like sections display mirror symmetry with respect to one another, and this can be in relation to the plane at which the sections are assembled.

The material from which the mixing elements are produced is preferably a metal alloy or a plastic and the two sections are advantageously welded together. Further, the mixing apparatus can have one or more mixing elements.

DETAILED DESCRIPTION OF THE PREFERRED EMBODIMENTS

Figure 1:
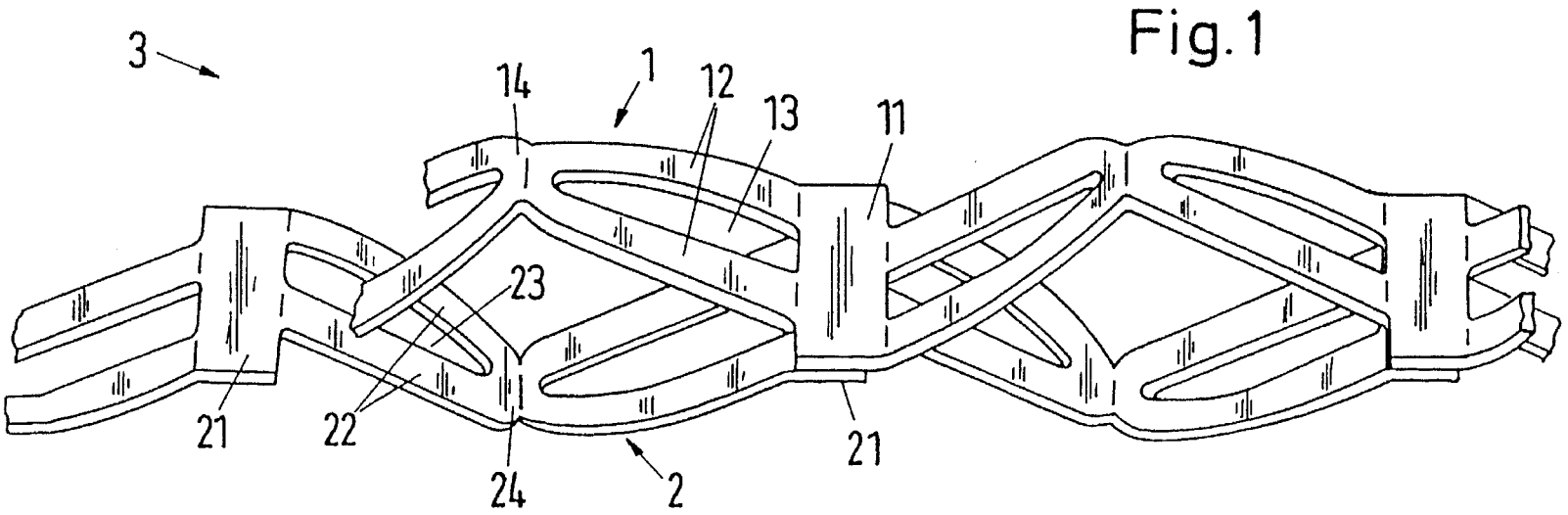
FIG. 1 is a detailed, perspective view of a mixing element for a mixing apparatus made according to the invention.

A mixing element 3 shown in FIG. 1 is formed from strip-like, substantially zig-zag or wavy sections 1 and 2.

Section 1 comprises bars or strips 12 generating a mixing action and an opening 13 defined by and located between two of the bars. Section 2 has corresponding bars 22 and openings 23. The two sections 1 and 2 have and they are connected to one another by transverse bars 11 and 21, for example by means of a spot weld. At the outer extreme points, bars 12 and 22 define connection pieces or segments 14 and 24, respectively. Sections 1 and 2 can be manufactured by stamping them from metal or plastic sheets and subsequently forming them. The sections may also be injection molded.

Figure 2:
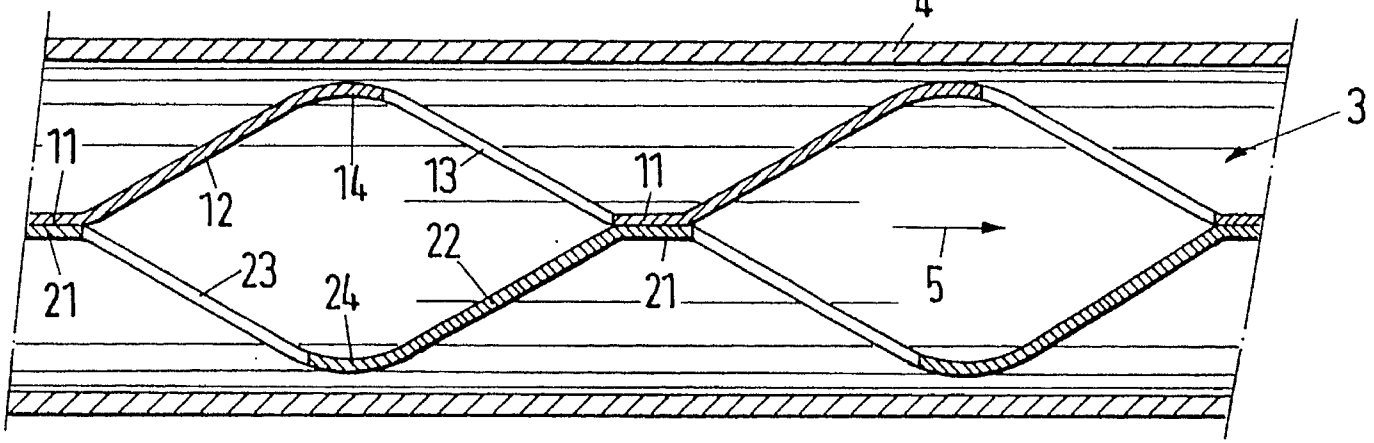
FIG. 2 is a longitudinal section through a mixing apparatus having the mixing element shown in FIG. 1.

FIG. 2 shows the manner in which mixing element 3 of FIG. 1 is arranged in a tubular housing 4. The main direction of flow is indicated by an arrow 5. Faces of the transverse bars 11, 21 abut, are located at the center of the tubular housing, and are parallel to the longitudinal axis of the housing so that the respective sections 1, 2 are entirely located in one or the other longitudinal housing half or sector, as is shown in FIG. 2.

Figure 3:
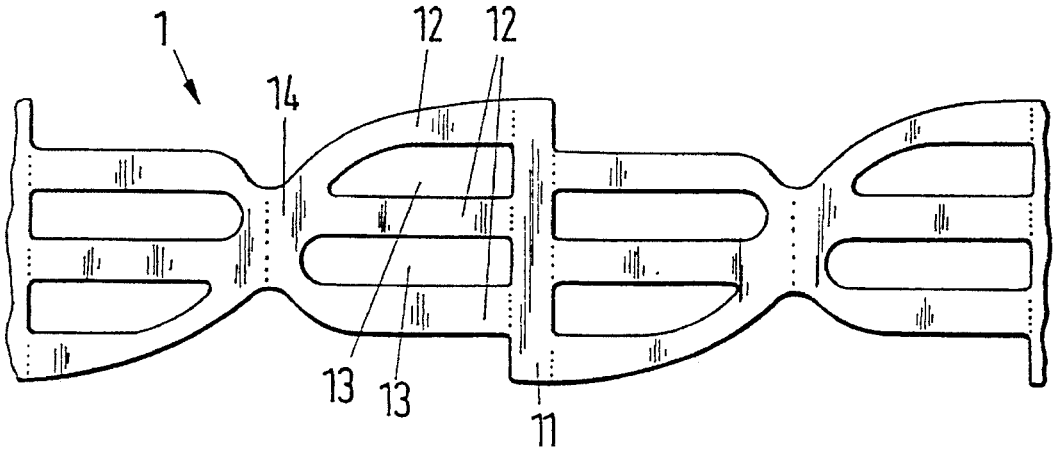
FIG. 3 is a plan view of a section of a second embodiment of the mixing element made according to the invention.
Figure 4:
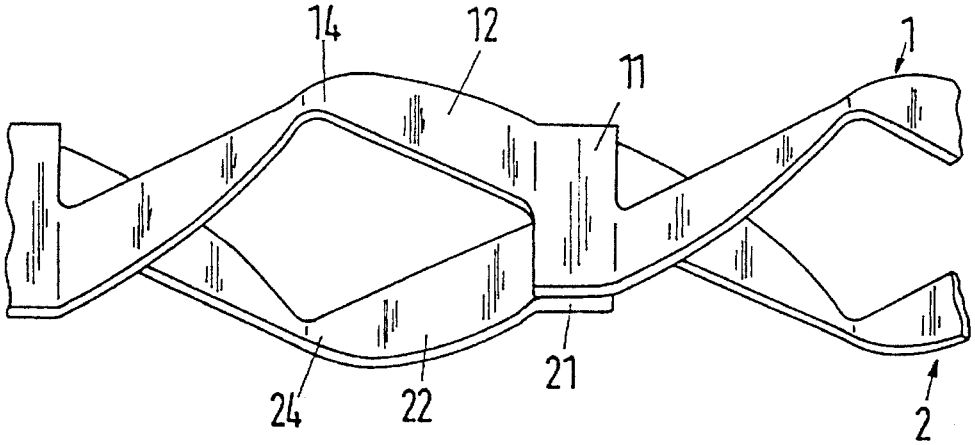
FIG. 4 shows a third embodiment.

The first embodiment of the invention shown in FIG. 1 uses a section 1 in the form of a rigid chain. The chain links comprise two parallel bars 12 which are angularly inclined relative to the flow direction 5 and cause a mixing action. A second embodiment shown in FIG. 3 employs a corresponding chain with three respective bars 12 and two associated openings 13. In a third embodiment of the invention, shown in FIG. 4, the chain links only comprise one bar which causes a mixing action.

Figure 5:
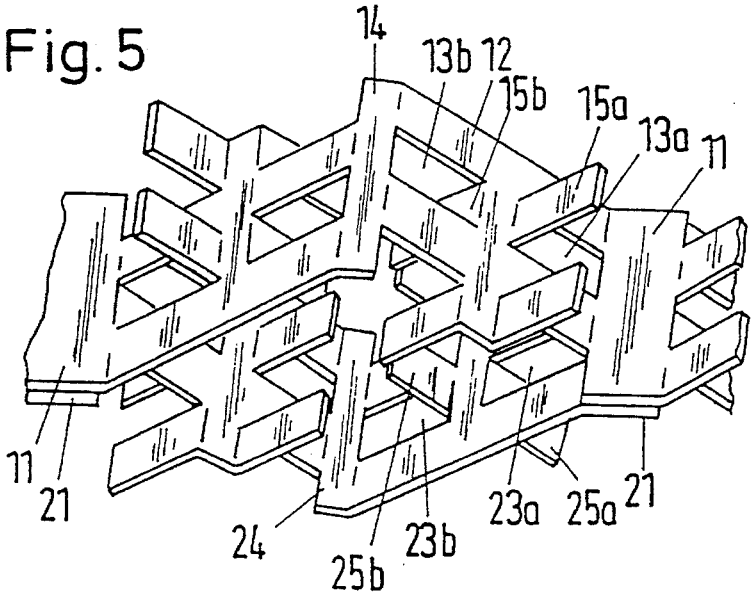
FIG. 5 shows a fourth embodiment.

FIG. 5 illustrates a fourth embodiment of the invention in which openings 13*a* and 13*b* (and 23*a* and 23*b* respectively) are formed by partially blanking out material and bending it outwardly so that the bent-out material sections 15*a* and 15*b* (and 25*a* and 25*b*) themselves perform the function of the bars and cause a mixing action.

Figure 6:
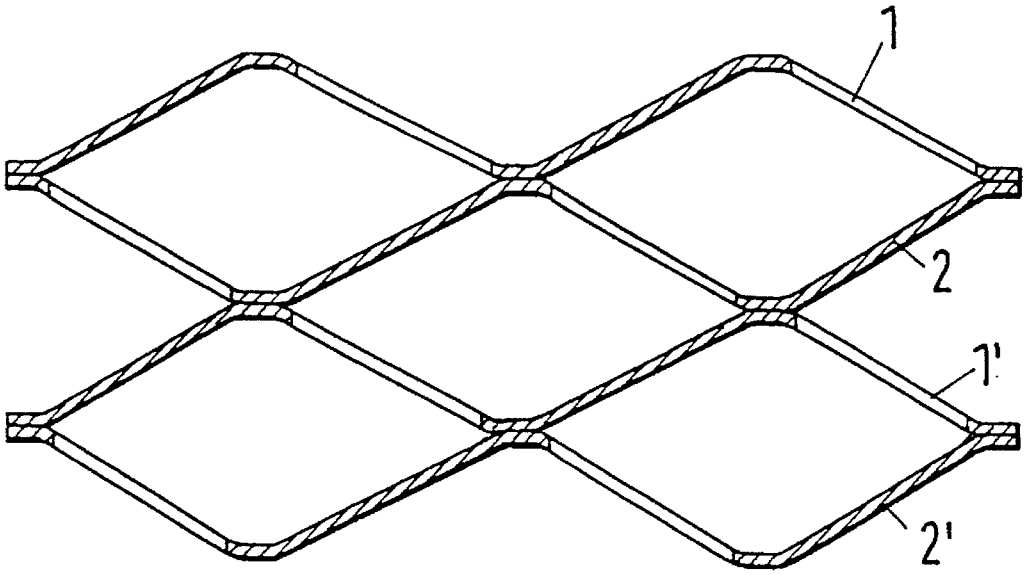
FIG. 6 is a longitudinal section through a mixing element having four sections.
Figure 7:
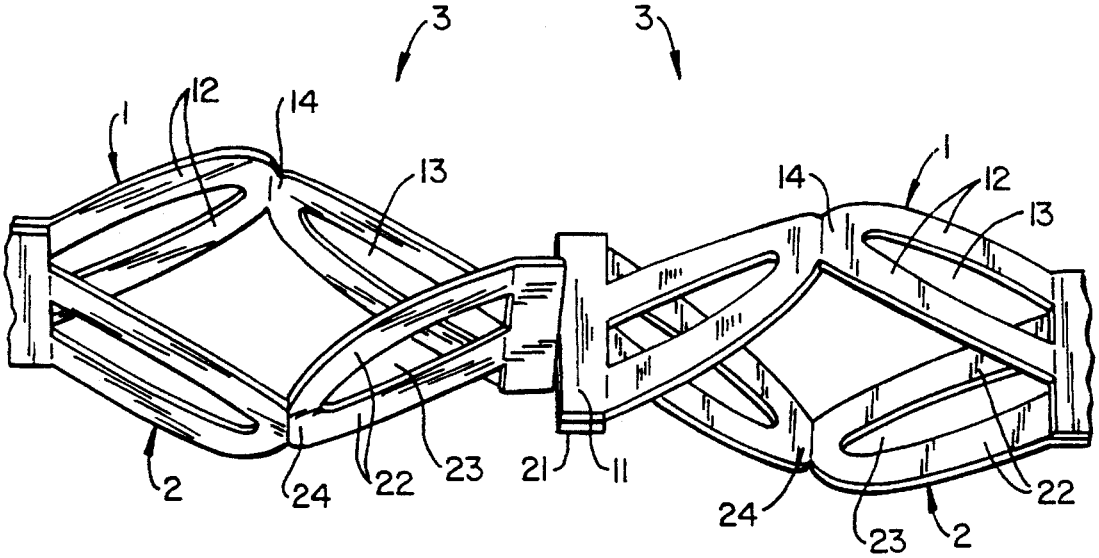
FIG. 7 is a perspective view which shows two mixing elements joined end-to-end and rotationally offset 90° C. with respect to each other.

A mixing element may be formed of more than two strip-like sections. FIG. 6 shows an example using four sections 1, 2 and 1', 2', respectively A mixing apparatus generally comprises more than one mixing element 3. Adjacent mixing elements are advantageously swivelled with respect to each other by an angle of preferably 90° C. relative to the main direction of flow as shown in FIG. 7. As is known in addition to using it in mixing operations, a mixing apparatus such as the mixing apparatus described herein can also be used in heat and material exchange operations.

What is claimed is:

1. A static mixing apparatus for a flowable medium comprising:

an elongated, tubular housing having a wall, an axis and a flow direction, the axis dividing an interior of the housing into longitudinally extending first and second interior housing sectors; and a mixing element disposed in and extending over a portion of the length of the housing, the mixing element including first and second elongated mixing sections of like shape, each section being substantially entirely disposed in a respective one of the housing sectors and comprising:

elongated, first and second, substantially parallel and spaced-apart material strips extending generally in the flow direction nonparallel to the housing axis;

first and second transverse bars oriented transversely to the housing axis having faces substantially aligned with the housing axis, said transverse bars connecting first and second ends of the strips and abutting faces of corresponding transverse bars of another one of the mixing sections disposed in the other one of the housing sectors; segments of the first and second material strips midway between and spaced from the transverse bars being joined to each other and positioned proximate the wall;

the material strips, the transverse bars and the segments defining asymmetric chain links of like shapes, and first and second, axially spaced-apart openings which are angularly inclined relative to the housing axis and wholly positioned in the respective one of the housing sectors, the section being further rotationally symmetrical about its longitudinal axis; and means securing the abutting faces of the transverse bars to each other;

whereby the medium flowing in the flow direction through the housing is mixed by the mixing element.

2. A static mixing apparatus according to claim 1 wherein the securing means comprises a weld.

3. A static mixing apparatus according to claim 1 including at least two mixing elements disposed in the interior of the housing and being axially rotationally offset with respect to each other by about 90°.

4. A static mixing apparatus according to claim 1 wherein the mixing sections are formed from metal.

5. A static mixing apparatus according to claim 1 wherein the mixing sections are formed from a plastic material.

* * * * *